United States Patent [19]

Smolders

[11] 4,279,184

[45] Jul. 21, 1981

[54] APPARATUS FOR PROCESSING LONGITUDINALLY-MOVING WEBS OF MATERIAL

[75] Inventor: Cees J. Smolders, Haarlem, Netherlands

[73] Assignee: Universal Corrugated Box Machinery Holding AG, Zug, Switzerland

[21] Appl. No.: 83,725

[22] Filed: Oct. 10, 1979

[51] Int. Cl.[3] ..... B26D 1/56

[52] U.S. Cl. ..... 83/302; 83/303; 83/408; 493/370; 493/369

[58] Field of Search ..... 83/300, 302, 303, 408, 83/923; 93/58.2 R, 58.2 F, 58.4, 1.6

[56] References Cited

U.S. PATENT DOCUMENTS

| | | | |
|---|---|---|---|
| 1,746,048 | 2/1930 | Novick | 83/300 |
| 2,598,820 | 6/1952 | Neese | 83/303 X |
| 2,751,983 | 6/1956 | Shields | 83/303 X |
| 2,836,018 | 5/1958 | Key | 83/303 X |
| 3,307,441 | 3/1967 | Saunders et al. | 83/302 |
| 3,478,654 | 11/1969 | Willard | 83/408 X |
| 3,489,043 | 1/1970 | Dent | 83/408 X |
| 4,007,652 | 2/1977 | Shinomiya et al. | 83/408 X |

FOREIGN PATENT DOCUMENTS

| | | | |
|---|---|---|---|
| 2146324 | 9/1971 | Fed. Rep. of Germany | 83/408 |
| 182502 | 1/1965 | U.S.S.R. | 83/303 |

*Primary Examiner*—Frank T. Yost
*Assistant Examiner*—Robert P. Olszewski
*Attorney, Agent, or Firm*—Thomas H. Murray; Clifford A. Poff

[57] ABSTRACT

At least three crosscutters for a web of corrugated board include a first crosscutter for the original width of the web and second and third crosscutters for cross-cutting slit subwebs having reduced widths as compared to the original web width. A module formed by the second and/or third crosscutters with less power and drive requirements is located in the same vertical plane as the crosscutter rolls of the first crosscutter or laterally displaced therefrom.

9 Claims, 2 Drawing Figures

APPARATUS FOR PROCESSING LONGITUDINALLY-MOVING WEBS OF MATERIAL

BACKGROUND OF THE INVENTION

Figure 2:
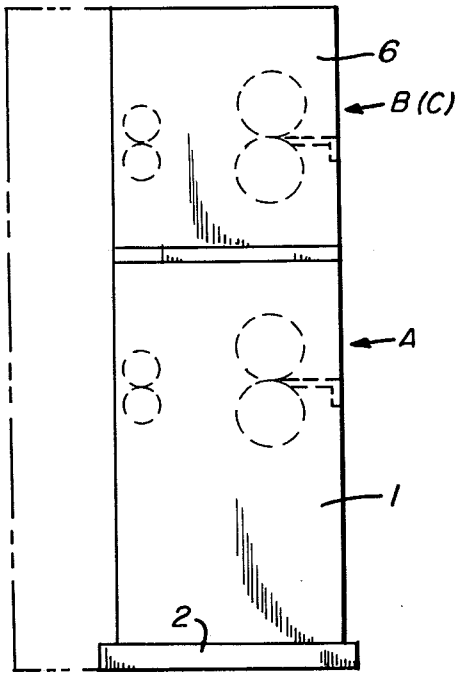

This invention relates to an arrangement of means for processing longitudinally-moving webs of material by cutting, coating, printing or the like and, more particularly, to treating webs of paper and board produced from an original one-piece web by dividing, preferably by longitudinally cutting the web for the subsequent treatment by an arrangement of apparatus for crosscutting the webs which are typically comprised of corrugated board.

Conventional machines for making corrugated board produce webs of board that are wider than the web of corrugated board required as the end product for making carton blanks. Cutting means are used to longitudinally divide the one-piece web of corrugated board into a number of parallel webs according to the width of the carton blank undergoing manufacture. Downstream in the production process, crosscutter means are provided to transversely cut the subwebs into portions of different length. In this way, carton blanks with different sizes can be made from a single web of corrugated board. Known crosscutter means take the form of rotary cutter rolls, flying shears, water-jet cutters, laser-beam cutters or the like.

Two crosscutter stations are generally used in known corrugated board-making machines so that two subwebs can be cut out transversely and independently of one another. The crosscutters are arranged either one above the other in the same transverse plane or one after the other at different heights with respect to the direction of movement of the web. West German Pat. No. 20 55 313 discloses a machine having two-crosscutters arranged one above the other. The crosscutters include rotary cutter rolls.

It has been proposed to arrange three crosscutters one after the other with the second and third crosscutters each disposed at a higher level than the preceding crosscutter so that it is possible to transversely cut three slit subwebs of different widths. It is a characteristic of the known arrangements of crosscutters in machines for making corrugated board that each individual crosscutter has a cutting length designed for the full width of the original web of material, although the subwebs which are severed thereby always have a much narrower width. Because of this design, the crosscutters cannot, as a rule, be used in an optimum manner in the known constructions because each individual crosscutter is so constructed and equipped in respect to its drive means that it can be used for cutting a web of material of the original width. The same inadequacies also occur with other means for processing longitudinally-moving webs of material, for example, coating, printing or similar means.

SUMMARY OF THE INVENTION

It is an object of the present invention to obviate the disadvantages enumerated above in regard to the known construction of means for processing longitudinally-moving webs of material.

It is a further object of the present invention to improve the utilization of means for processing longitudinally-moving webs of material without impairing the processing facilities as compared with known constructions for the processing of an original web of material having a full width.

More particularly, according to the present invention, there is provided apparatus for processing a longitudinally-moving web of material of predetermined width as well as a plurality of webs of shorter width produced by longitudinally slitting the original web of predetermined width, the apparatus comprising a first processing means having a processing width corresponding to the predetermined width and beyond which the original web can pass, and a plurality of additional processing means located at a different vertical position with respect to the first processing means and having individual processing widths smaller than the predetermined width of the moving web, the plurality of processing means spanning a distance substantially equal to the predetermined width of the moving web.

Thus, the present invention provides that the first processing means defines a processing width corresponding to the full width of the original web of material and at least second and third processing means at a different vertical position define smaller processing widths as compared to the width of the original web of material, the second and third processing means are arranged so that their processing zones at their outer extremities extend in each case to the outer edge of the original web of material.

Advantageously, the processing width of the second processing means is equal to one-half the width of the original web of material and the processing width of the third processing means is equal to one-third of the width of the original web of material. The principle of the invention can be utilized to great advantage in corrugated board crosscutters, for example, in processing systems wherein each pair of cutter rolls, disposed on opposite sides of the web of corrugated board, form a crosscutter. In an arrangement of three crosscutters, the principle of the invention is embodied by a first crosscutter with a cutting width equal to the full width of the original web of corrugated board, a second crosscutter having a cutting width equal to one-half the width of the original web of corrugated board, and a third crosscutter having a cutting width corresponding to one-third of the width of the original web of corrugaged board.

Numerous variations are possible within the scope of the present invention to meet the requirements in any particular instance in respect to the physical arrangement of the second and third crosscutters in relation to one another and in relation to the first crosscutter. Advantageously, the second and third crosscutters are disposed side-by-side at the same height in the same transverse plane. The first crosscutter for the full width of web of material can be disposed either in the same transverse plane as the second and third crosscutters or the first crosscutter can be offset therefrom. In either case, the first crosscutter may be vertically above or below the second and third crosscutters that can be in the form of a module.

The main advantages of the invention are that while retaining the processing facilities provided by three individual devices each designed for the full width of the web of material, the equipment required for the second and third processing means is greatly reduced because of the greatly reduced processing width thereof. The same applies to the power required to drive the two processing means with the reduced processing widths. The expenditure for maintenance of the processing means is also correspondingly reduced while accessibility is greatly improved, particularly when compared with the conventional embodiments of triple crosscutters.

Other advantages arising out of the present invention include a savings in weight due to the shorter support length of the cutter rollers of the shortened processing means whereby the risk of sag is reduced and, hence, the load-bearing cross sections, e.g., the shaft cross sections can be of smaller dimensions. Similarly, there are savings with respect to the required bearings and the external frame structures for the processing means with the shortened processing widths.

A further important advantage of the present invention arises out of a considerable reduction in the overall length of the apparatus when two shortened processing means are disposed side-by-side in the same transverse plane with respect to the longitudinal axis of the machine. By employing the principle of the present invention, three crosscutters require the same amount of space as a conventional double crosscutter or, depending upon the construction, a single crosscutter.

The principle of the present invention is applicable equally to systems comprised of four or more processing means. If, for example, there are four processing stations, all that is required apart from the first processing means for the full width of the original web of material, is a second processing means for one-half the width of the web of material, a third processing means for one-third of the width of the web of material and a fourth processing means for one-quarter of the width of the web of material.

Figure 1:
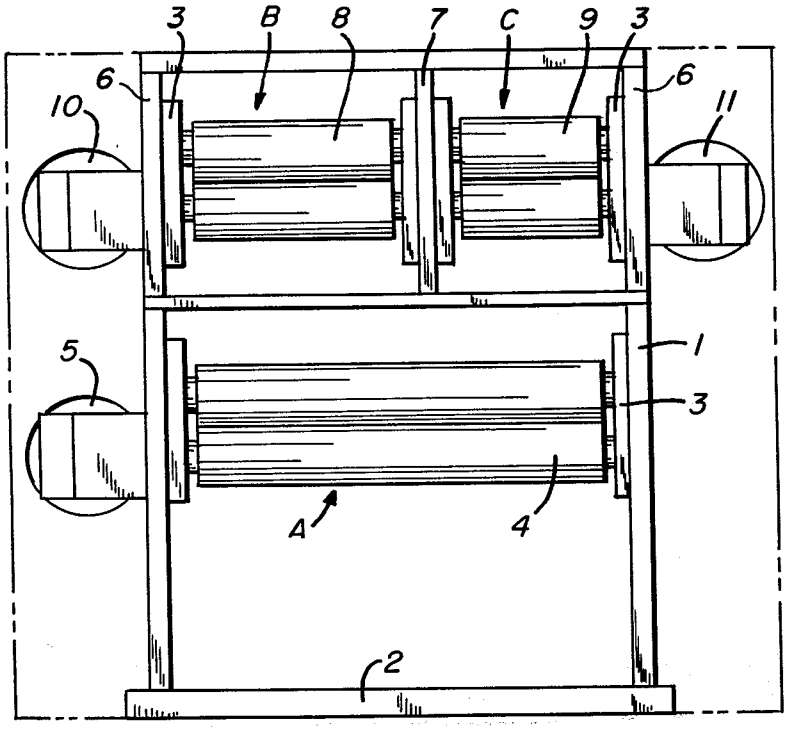

These features and advantages of the present invention as well as others will be more fully understood when the following description is read in light of the accompanying drawings, in which:

FIG. 1 is a front elevational view illustrating an arrangement of three crosscutters with pairs of rotating cutter rolls according to an embodiment of the present invention; and FIG. 2 is a side elevational view of the arrangement shown in FIG. 1 with the drives omitted.

In the exemplified embodiment of the invention shown in FIGS. 1 and 2, there is provided a first crosscutter A having a processing width corresponding to the full width of the original web of material and a second and a third crosscutter B and C, respectively, of reduced cutting widths which are smaller than the full width of the original web of material. These crosscutters are each disposed in in independent frame structures so that each frame structure can be inserted in a selected or variable manner in the form of a module in a machine for making corrugated board.

The frame structure for crosscutter A essentially includes two parallel side members 1 and a base plate 2 on which the side members are suitably fixed. Disposed on the inside surfaces of the side members 1 are bearing assemblies that rotatably mount to cutter rolls 4. The cutter rolls for crosscutter A and for crosscutters B and C may be of a construction that is conventional at the present time. It is possible without difficulty to employ cutter rolls having different diameters. The cutter rolls 4 of crosscutter A are driven by a common drive motor 5 which is mounted onto the outside of the frame and coupled to the shafts of the rolls 4 by way of a reduction gear.

The frame structure for crosscutters B and C essentially includes two outer side members 6 and a middle member 7 that are joined with suitable cross members at the top and bottom to form a rigid frame. The bearing assemblies for cutter rolls 8 and 9 are fixed to the inside of the side members 6 and 7. These bearing assemblies are constructed in the same manner as the bearing assemblies used for supporting the cutter rolls of crosscutter A. Thus, all the bearing assemblies are identified by reference numeral 3. Drive motors 10 and 11 and a transmission for each motor are provided on opposite outer side faces of the frame to drive the crosscutters B and C by coupling drive output shafts to the cutter rolls of these cutters.

As shown in FIG. 2, the exemplified embodiment of the present invention is such that the crosscutter A and the crosscutters B and C of shorter width are arranged one above the other in the same transverse plane with respect to the direction of movement of the web of material. It is possible without difficulty to arrange the top module containing the shorter width crosscutters B and C after the crosscutter A with respect to the direction of movement of the web of material. Such an arrangement is desirable, for example, in order to reduce the angle of deflection of the webs of material fed to the top crosscutters B and C.

It is frequently customary, in a machine for producing corrugated board of an initial width of 2500 millimeters, to provide that the knife-length or cutting width of the second crosscutter is about 1250 millimeters and the knife-length or cutting width of the third crosscutter is about 833 millimeters.

The arrangement of three crosscutters with different cutting widths as provided according to the present invention is suitable for crosscutting all widths of web as presently desired for processing paperboard. This applies not only to the division of the original web of material into three or more subwebs, but also for division into two subwebs including the extreme case where the original web of material is divided centrally.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. Apparatus for processing a longitudinally-moving web of material of predetermined width as well as a plurality of webs of shorter width produced by longitudinally slitting said original web of predetermined width, the apparatus comprising a first processing means having a processing width corresponding to said predetermined width and through which said original web can pass, a plurality of additional processing means located at a different vertical position with respect to said first processing means and having individual processing widths smaller than said predetermined width, said plurality of processing means spanning a distance substantially equal to said predetermined width, and superimposed frame means for supporting said first processing means at a vertically-spaced position from said plurality of additional processing means.

2. The apparatus according to claim 1 wherein said plurality of additional processing means includes a second processing means having a processing width to process one of said webs of shorter width corresponding to one-half of the predetermined width of said moving web of material, and a third processing means having a processing width to process another of said webs of shorter width corresponding to one-third of the predetermined width of said moving web of material.

3. The apparatus according to claim 1 or 2 wherein said first processing means and said plurality of additional processing means include crosscutters.

4. The apparatus according to claim 2 wherein said first, second and third processing means each includes a pair of rotating cutter rolls for crosscutting webs of corrugated paper.

5. The apparatus according to claim 2 wherein said second and third processing means include crosscutters supported in a side-by-side relation at the same height and within a common transverse plane.

6. The apparatus according to claim 1 further including means to support said first processing means beneath said plurality of additional processing means.

7. The apparatus according to claim 1 wherein said first processing means is disposed above said plurality of additional processing means.

8. The apparatus according to claim 1 wherein said first processing means and said plurality of additional processing means are disposed within the same transverse plane.

9. The apparatus according to claim 5 wherein said first processing means includes a crosscutter, and wherein said second and third processing means are offset from said first processing means with respect to the direction of the longitudinally-moving web of material and which is comprised of a web of corrugated paper.

* * * * *